US006331138B1

(12) United States Patent
Witters et al.

(10) Patent No.: US 6,331,138 B1
(45) Date of Patent: Dec. 18, 2001

(54) GRINDING MACHINE

(75) Inventors: Gilbert Filipe Maria Witters, Mortsel (BE); Johannes Petrus Van Vliet, Alphen aan de Rijn; Joop Henk Muller, Ter Aar, both of (NL)

(73) Assignees: Holland Industriele Diamantwerken B.V. (NL); Witcan N.V. (BE)

( * ) Notice: Subject to any disclaimer, the term of this patent is extended or adjusted under 35 U.S.C. 154(b) by 0 days.

(21) Appl. No.: 09/424,887

(22) PCT Filed: May 27, 1998

(86) PCT No.: PCT/NL98/00309

§ 371 Date: Apr. 10, 2000

§ 102(e) Date: Apr. 10, 2000

(87) PCT Pub. No.: WO98/53953

PCT Pub. Date: Dec. 3, 1998

(30) Foreign Application Priority Data

May 27, 1997 (NL) ..... 1006141

(51) Int. Cl.[7] ..... B24B 41/00

(52) U.S. Cl. ..... 451/340; 451/259; 451/350

(58) Field of Search ..... 451/340, 259, 451/270, 271, 268, 269

(56) References Cited

U.S. PATENT DOCUMENTS

| | | | | |
|---|---|---|---|---|
| 1,928,390 | | 9/1933 | Myers . | |
| 2,948,087 | | 8/1960 | Caton . | |
| 4,328,645 | | 5/1982 | Sauer . | |
| 5,637,032 | * | 6/1997 | Thysell et al. | 451/259 |

FOREIGN PATENT DOCUMENTS

| | | |
|---|---|---|
| 2929479 | 2/1981 | (DE) . |

* cited by examiner

*Primary Examiner*—Joseph J. Hail, III
*Assistant Examiner*—Daniel Shanley

(57) ABSTRACT

A grinding machine comprises a frame having a rotary casing that bears rotary holders for grinding discs, as well as a drive motor which is mounted on the frame and interacts with the casing and the holders to drive the machine. The drive motor is connected by means of a continuous flexible or articulated element to the holders for driving the latter in the direction of rotation, wherein at least one of the holders is coupled to the frame by means of a gear transmission, in order to bring the casing into rotation when said holder is driven.

8 Claims, 2 Drawing Sheets

GRINDING MACHINE

BACKGROUND OF THE INVENTION

1. Field of the Invention

This invention relates to grinding machines.

2. Introduction to the Invention

U.S. Pat. No. 1,928,390 discloses a grinding machine comprising a frame having a rotary casing that bears rotary holders for grinding discs, as well as a drive motor which is mounted on the frame and interacts with the casing and the holders to drive the machine. In this machine, a drive shaft is connected to the drive motor via a gear transmission and to the casing, which can thus be brought into rotation; and the holders for the grinding discs are brought into rotation via a V-belt, which is fed around a stationary pulley on the frame, and pulleys on the shafts of the holders.

A drive system of this type has various disadvantages. For instance, it is not easy to change the relative speeds of rotation of casing and holders with respect to one another, nor is it easy to change their relative direction of rotation. Because the drive shaft is connected directly to the casing, a reduction unit has to be incorporated between drive motor and said drive shaft, since otherwise the casing would rotate too rapidly.

SUMMARY OF THE INVENTION

The aim of the invention is to provide a grinding machine which does not have these disadvantages. Said aim is achieved in that the drive motor is connected by means of a continuous flexible or articulated element to the holders for driving the latter in the direction of rotation, and in that at least one of the holders is coupled to the frame by means of a gear transmission, in order to bring the casing into rotation when said holder is driven. The word "flexible" is used in this specification in its normal dictionary sense to mean "capable of being bent without breaking". Thus the term "flexible element" includes but is not limited to an articulated element.

With the grinding machine according to the invention the drive motor is connected to the grinding discs, which can be driven at a relatively high speed of rotation. It is therefore not necessary to provide a reduction transmission in the drive shaft: any necessary reduction in speed can easily be obtained by selecting, in a suitable manner, the diameters of the pulleys concerned.

The casing can rotate at an appreciably reduced speed of rotation, in which context the reduction in speed can be supplied by the gear transmission.

Said gear transmission can be obtained in wide variety of ways. However, an embodiment in which the frame has a sun gear that interacts with at least one satellite gear, which is rotatably connected to the casing and interacts with the at least one holder, is preferred.

In order to obtain the desired reduction in speed and/or relative direction of rotation of holders and casing, the at least one holder can have a shaft with a gear, which gear interacts with the satellite gear.

BRIEF DESCRIPTION OF THE DRAWING

The invention will be explained in more detail below with reference to an illustrative embodiment shown in the figures.

DETAILED DESCRIPTION OF THE INVENTION

Figure 1:
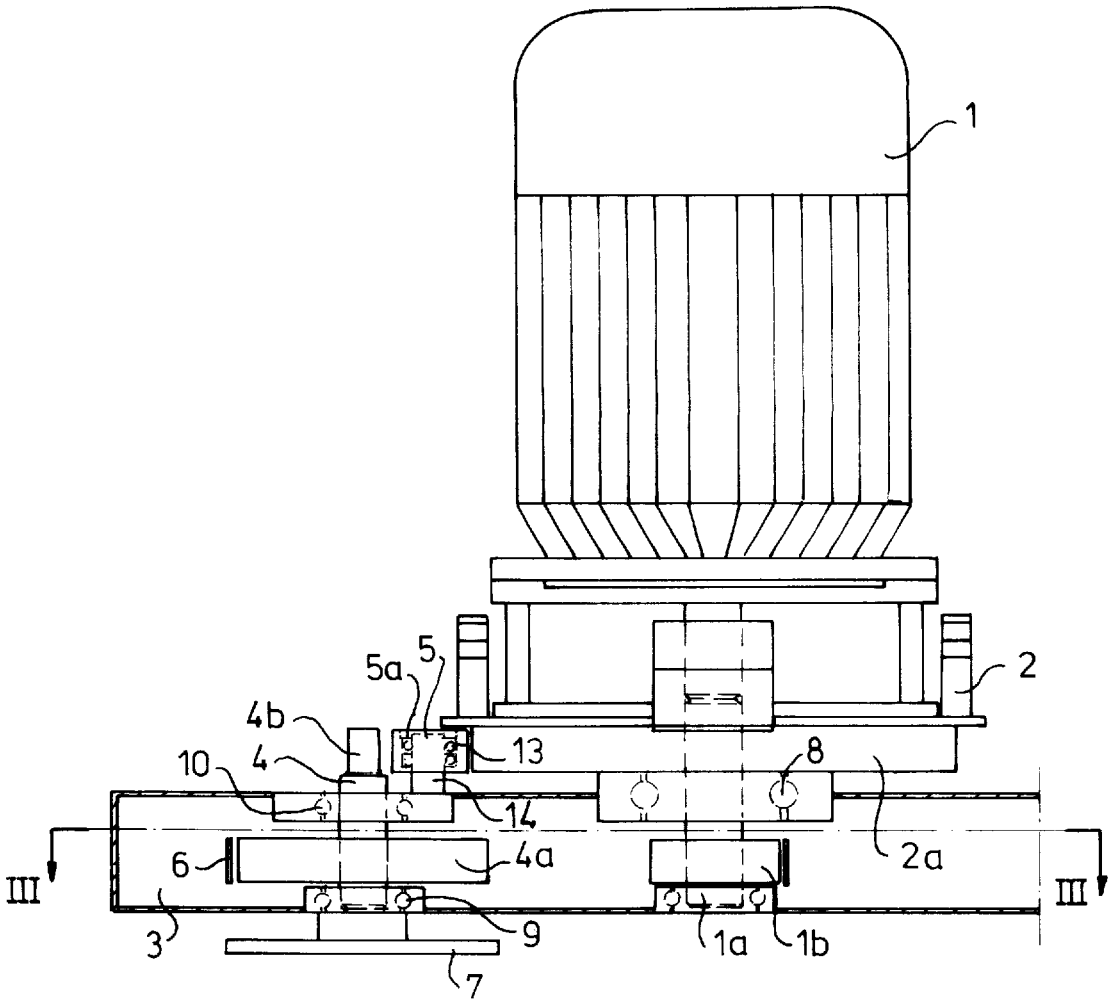
FIG. 1 shows a partial view, in cross-section, of the grinding machine according to the invention.

The grinding machine according to the invention shown in FIG. 1 comprises a drive motor 1 with drive shaft 1*a*. Said drive motor 1 is mounted on a frame 2, on which an operating device, which is not further shown, can be mounted.

The frame 2 has a sun gear 2*a* and is further connected via bearing 8 to the casing 3, which can be rotated relative to the frame 2.

Three holders 7 for grinding discs are rotatably mounted in the rotary casing 3. Each holder has a shaft 4, which is rotatably connected to the casing 3 by means of bearings 9, 10.

A pulley 4*a* is mounted on each shaft 4, whilst a pulley 1*b* is mounted on the drive shaft 1*a*. As can be seen in the cross-section according to FIG. 3, a drive belt 6 is fed around said pulleys such that the holders 7 together with grinding discs rotate in a direction counter to the drive shaft 1*a*. Tensioning wheels 11, 12 also engage on the drive belt 6, the latter tensioning wheel 12 being able to maintain the pre-tension in the drive belt 6 by means of spring contact.

Figure 2:
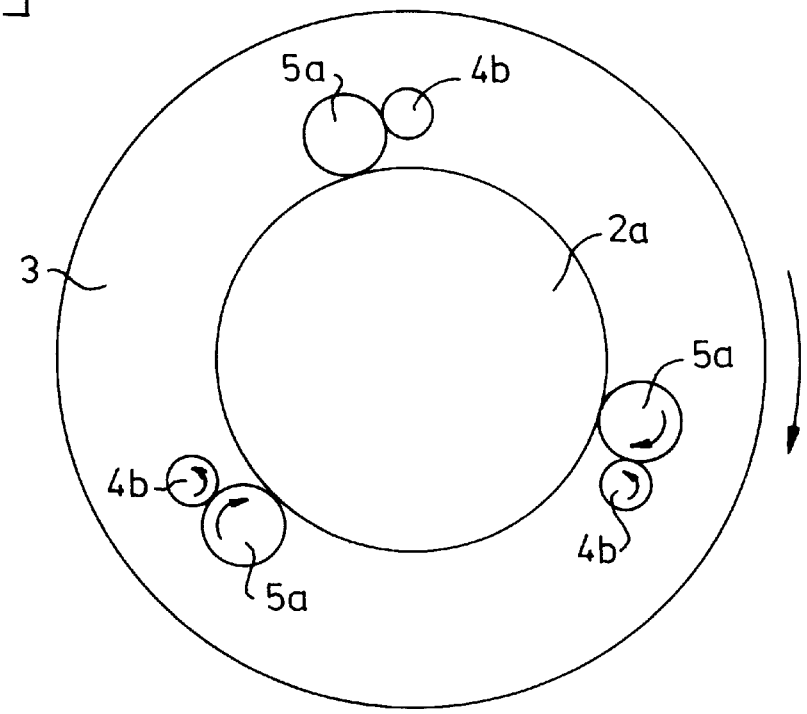
FIG. 2 shows a top view.
Figure 3:
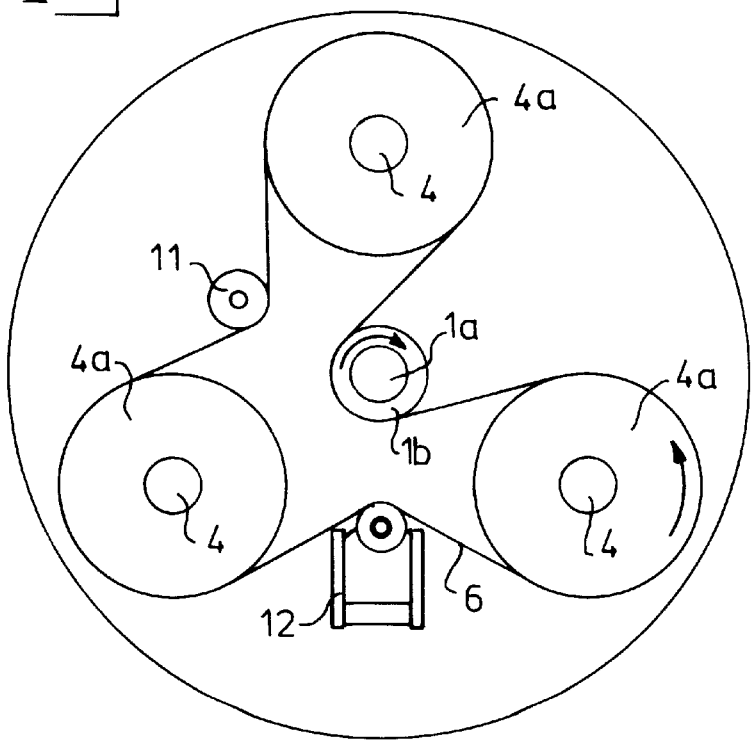
FIG. 3 shows the cross-section III—III according to FIG. 1.

A gear 4*b* is mounted on each shaft 4, which shafts 4 protrude above the casing 3. Said gears 4*b* interact with planetary gears 5*a*, which are each supported by means of bearings 13 on a shaft 14. The planetary gears 5*a*, which on rotation of the holders 7 with grinding discs are driven by the gears 4*b*, turn around the sun gear 2*a* on the frame such that the casing 3, as shown in FIGS. 2 and 3, acquires a direction of rotation which is counter to that of the holders 7 with grinding discs.

By using gears 4*b* and planetary gears 5*a* with different diameters, the relative speed of rotation of the holders 7 with grinding discs, on the one hand, and of the casing 3, on the other hand, can easily be varied. By making the gears 4*b* engage directly on the sun gear 2*a*, it is also possible to make the casing rotatable in the same direction as the holders 7 with grinding discs.

What is claimed is:

1. A grinding apparatus which comprises (1) a rotary casing which includes a sun gear;

(2) a plurality of rotary disk holders, each of which is mounted on the casing and includes a disk holder shaft and a holder for a grinding disk;

(3) a drive shaft;

(4) a continuous flexible element which couples the drive shaft to the disk holders so that rotation of the drive shaft causes rotation of each of the disk holders; and (5) at least one gear transmission which comprises (i) a disk holder shaft gear mounted on one of the disk holder shafts and (ii) a satellite gear which couples the disk holder shaft gear to the sun gear of the rotary casing so that rotation of the holder causes rotation of the frame.

2. An apparatus according to claim 1, wherein the continuous flexible element passes around a pulley on the drive shaft and around a pulley on each of the disk holders.

3. An apparatus according to claim 1, wherein there are three said rotary disk holders and three said gear transmissions.

4. An apparatus according to claim 1 comprising a drive motor which is attached to and can drive the drive shaft.

5. An apparatus according to claim 1 comprising a frame to which the rotary casing is rotatably attached, and on which a drive motor for driving the drive shaft can be mounted.

6. A grinding apparatus which comprises (1) a drive motor;

(2) a frame on which the drive motor is mounted;

(3) a rotary casing which is secured to the frame and which includes a sun gear;

(4) three rotary disk holders, each of which is mounted on the casing and includes a disk holder shaft and a holder for a grinding disk;

(5) a drive shaft which is driven by the drive motor;

(6) a continuous flexible element which couples the drive shaft to the disk holders so that rotation of the drive shaft causes rotation of each of the disk holders; and (7) three gear transmissions each of which comprises (i) a disk holder shaft gear mounted on one of the disk holder shafts and (ii) a satellite gear which couples the disk holder shaft gear to the sun gear of the rotary casing so that rotation of the disk holders causes rotation of the frame.

7. An apparatus according to claim 6, wherein the continuous flexible element passes around a pulley on the drive shaft and around a pulley on each of the disk holders.

8. An apparatus according to claim 7, wherein the flexible element and the pulleys on the drive shaft and the disk holders are arranged so that each of the disk holders rotates in a direction opposite to that of the drive shaft.

* * * * *